United States Patent [19]

Simenc et al.

[11] 4,299,592

[45] Nov. 10, 1981

[54] PRINTING OF TEXTILE MATERIALS

[75] Inventors: Toni Simenc, Mannheim; Harro Petersen, Frankenthal, both of Fed. Rep. of Germany

[73] Assignee: BASF Aktiengesellschaft, Ludwigshafen, Fed. Rep. of Germany

[21] Appl. No.: 104,867

[22] Filed: Dec. 18, 1979

[30] Foreign Application Priority Data

Jan. 18, 1979 [DE] Fed. Rep. of Germany ..... 2901823

[51] Int. Cl.[3] ..... D06P 1/58; D06P 3/85

[52] U.S. Cl. ..... 8/496; 8/532; 8/552; 8/566

[58] Field of Search ..... 8/62, 496, 552, 573, 8/566, 585, 586, 532

[56] References Cited

U.S. PATENT DOCUMENTS

| | | | |
|---|---|---|---|
| 2,093,651 | 9/1937 | Widner et al. | 8/5 |
| 2,888,420 | 5/1959 | Sulzer et al. | 8/18 |
| 3,099,635 | 7/1963 | Wagner et al. | 8/18 |
| 3,132,965 | 5/1964 | Schmidt et al. | 8/18 |
| 3,411,860 | 11/1968 | Braun et al. | 8/18 |
| 3,418,063 | 12/1968 | Ulrich et al. | 8/21 |
| 3,706,525 | 12/1972 | Blackwell et al. | 8/21 |
| 3,888,624 | 6/1975 | Blackwell et al. | 8/21 |
| 4,063,879 | 12/1977 | Faulhaber et al. | 8/2.5 |
| 4,072,462 | 2/1978 | Vellins et al. | 8/2.5 |
| 4,088,440 | 5/1978 | Leimbacher et al. | 8/541 |
| 4,225,310 | 9/1980 | Acton et al. | 8/532 |
| 4,236,890 | 12/1980 | Blanchard et al. | 8/470 |
| 4,239,491 | 12/1980 | Baumgarte et al. | 8/532 |

OTHER PUBLICATIONS

CA 87: 203010x 1977.

*Primary Examiner*—Joseph L. Schofer
*Assistant Examiner*—Maria Parrish Tungol
*Attorney, Agent, or Firm*—Oblon, Fisher, Spivak, McClelland & Maier

[57] ABSTRACT

A process for printing textile materials consisting of cellulosic fibers, or of blends of cellulosic fibers and synthetic fibers, using a print paste which contains a synthetic thickener and a disperse dye, with or without conventional assistants, and, per 1,000 parts by weight of print paste, from 40 to 250 parts by weight of an N-methylol compound or N-methylol-ether compound of urea, of a urea derivative or of a carbamic acid ester, the print being fixed at an elevated temperature. The resulting prints have exceptionally good washfastness.

8 Claims, No Drawings

PRINTING OF TEXTILE MATERIALS

The present invention relates to a process for printing textile materials consisting of cellulosic fibers or of blends of cellulosic fibers with synthetic fibers, using a print paste which contains a synthetic thickener and a disperse dye, with or without conventional assistants, the print being fixed at an elevated temperature.

German Pat. No. 1,811,796 discloses a process for dyeing or printing cellulosic fibers, or blends of cellulosic fibers and synthetic fibers, wherein the cellulosic fibers and the synthetic fibers are dyed with a disperse dye. In order to be able to dye the cellulosic fibers with a water-insoluble dye, the said fibers must first be swollen in water and then treated with a solution of the water-insoluble dye in a polyalkylene glycol derivative. The color yield obtained with this process is not fully satisfactory.

It is an object of the present invention to improve the process described at the outset in such a way that prints with improved crocking fastness and washfastness are obtained, so that the prints can be subjected to an intensive reductive after-treatment to clean them.

We have found that this object is achieved, according to the invention, by using the process described at the outset if the print pastes additionally contain an N-methylol compound or N-methylol-ether compound of urea, of a urea derivative or of a carbamic acid ester.

For the purposes of the invention, textile materials are slivers, webs, yarns, circular-knit hose, piece goods, woven fabrics and carpets. The textile materials contain cellulosic fibers, or consist of such fibers. The process according to the invention is preferentially used for dyeing fiber blends of cotton and polyester.

The print pastes substantially consist of a synthetic thickener and a disperse dye. Disperse dyes are commercially available and are adequately characterized in the Color Index. They constitute a group of dyes which are sparingly soluble or insoluble in water and which may belong to a great variety of dye categories, for example of the anthraquinone, azo, acridone, coumarin, perinone, quinophthalone, indigo, thioindigo or phthalocyanine type. Disperse dye formulations which contain nonionic and/or anionic dispersants are used to prepare the print pastes.

Synthetic thickeners are also commercially available. These are, for example, homopolymers or copolymers of ethylenically unsaturated carboxylic acids of 3 to 5 carbon atoms. In particular, polymers of acrylic acid, methacrylic acid, maleic acid, maleic anhydride, fumaric acid an itaconic acid, and copolymers of the said carboxylic acids with one another, such as copolymers of acrylic acid with methacrylic acid in a molar ratio of 1:1 or in some other molar ratio, and copolymers of the said carboxylic acids with other copolymerizable ethylenically unsaturated monomers, such as vinyl esters, acrylic acid esters, methacrylic acid esters, ethylene, styrene, vinyl ethers and amides of ethylenically unsaturated $C_3$-$C_5$-carboxylic acids, are used. The copolymers contain at least 40, and preferably from 75 to 99.5, percent by weight of an ethylenically unsaturated carboxylic acid. The thickeners are as a rule high molecular weight polymers.

Polymers of particularly high molecular weight, which are very effective thickeners, are obtained when ethylenically unsaturated carboxylic acids, with or without the above copolymerizable ethylenically unsaturated comonomers, are copolymerized with comonomers which contain two ethylenically unsaturated double bonds. Examples of such comonomers are butadiene, divinylbenzene, butanediol diacrylate, glycol diacrylate, divinyldioxane and diallyl phthalate. Units of these comonomers account for from about 0.05 to 5 percent by weight of the high molecular weight copolymers.

The thickening action of the homopolymers or copolymers of ethylenically unsaturated carboxylic acids manifests itself on partially or completely neutralizing the polymers with bases in an aqueous medium. Examples of suitable bases are sodium hydroxide solution, potassium hydroxide solution, ammonia and amines, e.g. triethylamine, butylamine, ethanolamine, triethanolamine, hexamethylenediamine, diethylenetriamine and triethylenetetramine, as well as mixtures of ammonia and morpholine, or of hexamethylenediamine and morpholine. On neutralizing the synthetic thickeners with the said bases, aqueous solutions are obtained which at a concentration of 1 percent by weight have a viscosity of from 2,000 to 20,000 mPas at 20° C. and pH 6. The neutralized or partially neutralized synthetic thickeners have a pH of from 3 to 8, preferably from 4 to 6.

The print paste may or may not contain conventional assistants, for example emulsifiers, dispersants, levelling agents, pH regulators, fixing accelerators, anti-foam agents, oxidizing agents and reducing agents. These additives are used in the conventional amounts.

For the novel process for printing textile materials, containing or consisting of cellulosic fibers, with disperse dyes, the print pastes must contain an N-methylol compound or N-methylol-ether compound of urea, of a urea derivative or of a carbamic acid ester. These compounds may be defined, for example, by the formulae I to III. In the formula

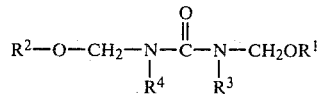

(I)

$R^1$, $R^2$, $R^3$ are hydrogen or $C_1$-$C_6$-alkyl, $R^3$ and $R^4$ are, in addition, radicals of the formula

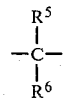

which are joined to one another directly or via

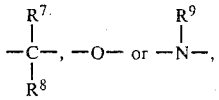

where $R^5$ and $R^7$ are hydrogen, $C_1$-$C_4$-alkyl or low molecular weight alkoxyalkyl, $R^6$ and $R^8$ are hydrogen, OH, low molecular weight alkoxy or $C_1$-$C_4$-alkyl and $R^9$ is hydrogen, $C_1$-$C_6$-alkyl or low molecular weight hydroxyalkyl.

Specific examples of compounds of the formula I are N-methylolurea and derivatives of urea, eg. of monoalkylureas or of symmetrical dialkylureas, which contain 2 or more hydroxymethyl groups or low molecular weight alkoxymethyl groups, eg. N,N'-dihydroxymethylurea, N,N'-dimethoxymethylurea, N,N'-dibutoxymethyl-N-methylurea, N,N',N'-trimethoxymethyl-N-ethylurea and N,N'-diethoxymethyl-N,N'-dimethylurea, the N,N'-dihydroxymethyl derivatives and low molecular weight N,N'-dialkoxymethyl derivatives of ethyleneurea (=imidazolid-2-one), N,N'-1,2-propyleneurea (=4-methylimidazolid-2-one), propyleneurea (hexahydropyrimid-2-one), 5-hydroxyhexahydropyrimid-2-one, 4-hydroxy- and 4-alkoxy-5,5-dialkylhexahydropyrimid-ones in which the alkyl and alkoxy groups are of low molecular weight, especially 4-hydroxy- and 4-methoxy-5,5-dimethyl- and -5,5-diethylhexahydropyrimid-2-one, hexahydro-1,3,5-triazin-2-one and its 5-alkyl and 5-hydroxyalkyl derivatives, glyoxalmonourein and urones. Preferred low molecular weight alkyl, hydroxyalkyl, alkoxy and alkoxymethyl groups are those where alkyl is of 1 to 6 carbon atoms.

Other examples are N-methylolated and/or etherified N-methylol compounds of aminotriazines, eg. melamine, ammeline and ammelide, of dicyandiamide and of thiourea.

Further suitable compounds for the process according to the invention are those of the formula

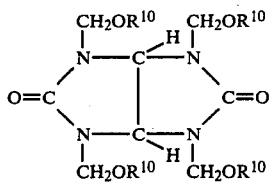

(II)

where the substituents $R^{10}$ may be identical or different and each is hydrogen, $C_1$-$C_6$-alkyl or low molecular weight alkoxyalkyl.

Examples of compounds of the formula II are acetylenediurea derivatives containing N-methylol groups and/or N-methylol-ether groups. These derivatives contain at least 2 N-methylol groups and/or N-methylol-ether groups.

Suitable carbamic acid esters have the formula

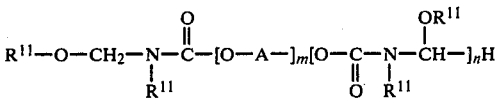

(III)

where the substituents $R^{11}$ may be identical or different and each is hydrogen, $C_1$-$C_6$-alkyl or low molecular weight alkoxyethyl, A is an aliphatic hydrocarbon radical of 2 to 8 carbon atoms, m is from 1 to 9 and n is 0 or 1.

Examples of compounds of the formula III are the hydroxymethyl derivatives and the low molecular weight alkoxymethyl derivatives of monocarbamic acid esters and dicarbamic acid esters (monourethanes and diurethanes), eg. of ethyl carbamate, propyl carbamate, butyl carbamate, octyl carbamate, propyl N-methylcarbamate, butyl N-methylcarbamate, octyl N-methylcarbamate, ethyl N-methylcarbamate, butyl N-ethylcarbamate, and dicarbamic acid esters and di-N-ethylcarbamic acid esters of ethylene glycol, 1,3- or 1,4-butanediol, 1,6-hexanediol and polyglycol ethers.

1,000 parts by weight of the finished print paste contain from 20 to 250, preferably from 50 to 150, parts by weight of one or more N-methylol compounds or N-methylol-ether compounds of urea, of the urea derivative or of a carbamic acid ester. The synthetic thickeners are used in amounts of from 5 to 20, preferably from 7.5 to 15, parts by weight per 1,000 parts by weight of the finished print paste. The disperse dyes are employed in the amounts conventionally used for print pastes, for example, in the case of black colorations, up to 120 parts by weight per 1,000 parts by weight of print paste. An advantage of the process according to the invention is that the print pastes employed are free from gasoline.

Using the novel printing process, prints of exceptionally good washfastness are obtained. This is borne out by the fact that the process is the only printing process hitherto disclosed for cotton/polyester fiber blends which permits intensive reductive after-treatment to clean the print. Accordingly, the prints obtained also have very good fastness to crocking. The reductive wash of course eliminates the problem of staining of the white ground. This has hitherto presented a problem when printing cotton/polyester blends.

However, a reductive after-treatment is not a precondition for the novel process. Where the standard of fastness to crocking need not be extremely high, the conventional afterwash can be omitted.

The simplicity of the novel process, and the great brilliance, good evenness and depth of color of the prints are further advantages over conventional printing processes.

To obtain a 1/1 standard depth, the amount of dye employed is half as much as in processes where mixtures of vat dyes and disperse dyes or mixtures of reactive and disperse dyes are used, apart from the advantage that in the process according to the invention printing is carried out with only one type of dye.

The Examples which follow, in which parts are by weight, illustrate the invention.

EXAMPLE 1

A 67:33 polyester/cotton fabric weighing about 160 g per square meter is printed with a print paste which comprises 40 parts of the red disperse dye of the formula

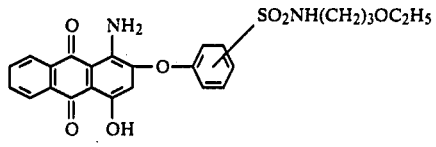

35 parts of a 30% strength water-swollen thickener which consists of a 1:1 mixture of a maleic anhydride/isobutyl vinyl ether copolymer and a high molecular weight divinyl-dioxane-crosslinked polyacrylic acid and has been brought to a pH of 5 by adding a 1:1 by weight mixture of ammonia and sodium hydroxide solution of 38° Bé strength, 10 parts of a 50% strength aqueous polyethylene dispersion and 80 parts of the compound of the formula

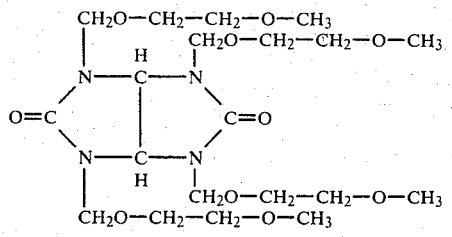

(1,3,4,6-tetrakis-(ethoxymethoxymethyl)-glycoluril)

and water to make up the mixture to 1,000 parts. After printing with this print paste, the fabric is dried and the print is fixed for 6 minutes in live steam at 175° C. This is followed by a reductive after-treatment with a liquor which contains, per liter, 2 grams of sodium dithionite, 4 grams of sodium hydroxide solution of 38° Bé strength and 1 gram of a detergent. This treatment is carried out for 10 minutes at 60° C., after which the fabric is washed in the conventional manner. A brilliant deep red print with very good washfastness and fastness to crocking is obtained, and the fabric has a pleasant hand.

EXAMPLE 2

Example 1 is repeated, except that the print paste contains 30 parts of the orange disperse dye of the formula

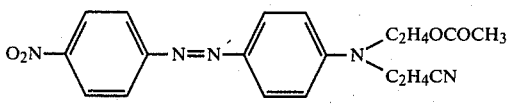

instead of the dye used in Example 1. A brilliant deep orange print with very good washfastness and fastness to crocking is obtained, and the fabric has a pleasant hand.

EXAMPLE 3

Example 1 is repeated, except that the print paste contains 40 parts of the violet disperse dye of the formula

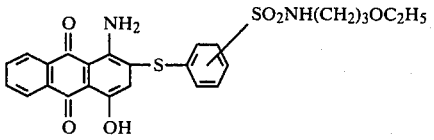

instead of the dye used in Example 1. A brilliant deeply colored print with very good washfastness and fastness to crocking is obtained, and the fabric has a pleasant hand.

EXAMPLE 4

A 50:50 polyester/cotton fabric weighing 90 grams per square meter is printed with a print paste which comprises the following constituents:

40 parts of the blue disperse dye of the formula

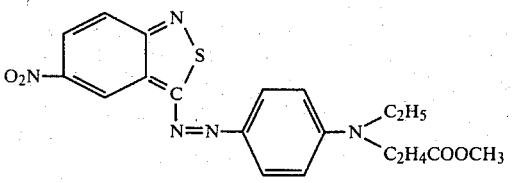

35 parts of a 30% strength aqueous mixture of a high molecular weight polyacrylic acid crosslinked with butanediol diacrylate, the mixture having been brought to pH 4.5 by adding concentrated ammonia, 90 parts of the compound of the formula

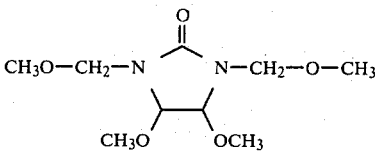

and water to make up to 1,000 parts. The printed fabric is dried and the print is then fixed for 2 minutes in hot air at 210° C. It is then subjected to reductive cleaning for 10 minutes at 60° C. in a liquor which contains, per liter, 2 grams of sodium dithionite, 4 grams of sodium hydroxide solution of 38° Bé strength and 1 gram of a detergent. Washfast deep brilliant level prints in which the cotton and polyester have matching shades are obtained, and the fabric has a very soft hand.

EXAMPLE 5

Example 4 is repeated, except that the red disperse dye of the formula

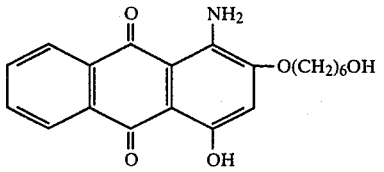

is used. A red, washfast, deep, brilliant and very level print is obtained and the fabric has a very soft hand.

EXAMPLE 6

Example 4 is repeated except that in place of the dye used there 40 parts of the blue disperse dye of the formula

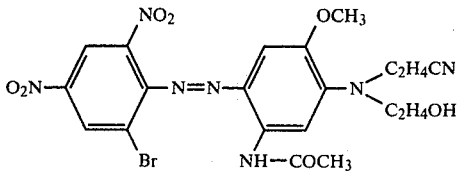

are used. A very washfast, deep, brilliant blue print is obtained and the fabric has a very soft hand.

EXAMPLE 7

A 67:33 polyester/cotton fabric weighing 160 grams per square meter is printed with a print paste which comprises the following components: 25 parts of the yellow disperse dye Color Index No. C.I. 47,023, 35 parts of a 30% strength aqueous solution of a high molecular weight polyacrylic acid crosslinked with 1.5 percent by weight of divinyldioxane, 10 parts of a 30% strength commercial aqueous silicone oil emulsion, 100 parts of the compound of the formula

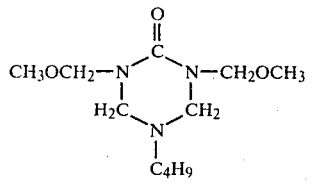

(1,3-dimethoxymethyl-5-isobutyl-hexahydrotriazin-2-one)

and water to make up to 1,000 parts. The printed fabric is dried, the print is then fixed for 8 minutes in live steam at 180° C., and subjected to reductive cleaning as described in Example 4, and the fabric is rinsed with water. A level, deep, brilliant and washfast yellow print is obtained.

EXAMPLE 8

Example 7 is repeated except that in place of the dye used there 40 parts of the blue disperse dye of the formula

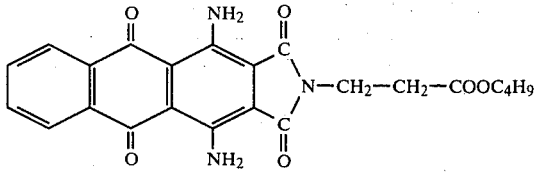

are employed. Again, level, deep, brilliant and washfast prints are obtained.

EXAMPLE 9

Example 7 is repeated, replacing the dye used there by 40 parts of the orange disperse dye Color Index No. 26,080. An orange, level, deep, brilliant and washfast print is obtained.

EXAMPLE 10

A pure cotton fabric weighing about 180 g per square meter is printed overall with an aqueous print paste which, in 1,000 parts, contains 50 parts of the red disperse dye of the formula

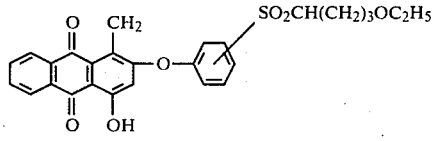

40 parts of a 30% strength water-swollen 1:1 copolymer of maleic anhydride and vinyl isobutyl ether, which has been brought to pH 5.0 with a 1:1 mixture of $NH_3$ and NaOH of 38° Bé strength, 20 parts of a 50% strength aqueous polyethylene dispersion and 160 parts of 1,3,4,6-tetrakis(ethoxymethoxymethyl)-glycoluril (cf. Example 1) and water to make up to 1,000 parts. The print is fixed and the fabric then afterwashed as in Example 1. A deep, brilliant print with very good washfastness is obtained, and the fabric has a pleasant hand.

The reactive product present in the print paste additionally imparts a wrinkle-resist and nonshrink finish. The synthetic thickener catalyzes the crosslinking of the N-methylol compound or N-methylol-ether compound used according to the invention.

We claim:

1. A process for printing textile materials consisting of cellulose fibers or mixtures thereof with synthetic fibers, comprising:

formulating a print paste consisting essentially of a synthetic thickening agent which is a homopolymer or copolymer of an ethylenically unsaturated carboxylic acid of 3 to 5 carbon atoms, a disperse dye, a fixing agent and auxiliaries, said formulation containing from 40 to 250 parts by weight of a fixing agent selected from the group consisting of N-methylol compounds of urea and urea derivatives, N-methylol ether compounds of urea and urea derivatives, and N-methylol and N-methylol ether compounds of carbamic acid esters per 1000 parts by weight of said print paste;

applying said print paste to said textiles; and fixing said dye at an elevated temperature.

2. The process as claimed in claim 1, wherein said print paste contains dispersed dye formulations containing a non-ionic dispersant, an anionic dispersant or mixture thereof.

3. The process as claimed in claim 1 or 2, wherein the N-methylol compound or N-methylol-ether compound is a compound of the formula:

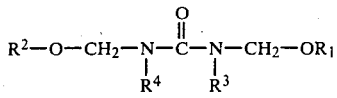

(I)

wherein $R^1$, $R^2$, $R^3$ and $R^4$ are hydrogen or $C_1$-$C_6$-alkyl, $R^3$ and $R^4$ are, in addition, radicals of the formula

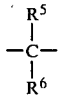

which are joined to one another directly or by

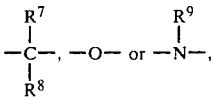

wherein $R^5$ and $R^7$ are hydrogen, $C_1$-$C_4$-alkyl or low molecular weight alkoxyalkyl, $R^6$ and $R^8$ are hydrogen, OH, low molecular weight alkoxy or $C_1$-$C_4$-alkyl and $R^9$ is hydrogen, $C_1$-$C_6$-alkyl or low molecular weight hydroxyalkyl.

4. The process as claimed in claim 1 or 2, wherein said N-methylol compound or N-methylol-ether compound is a compound of the formula:

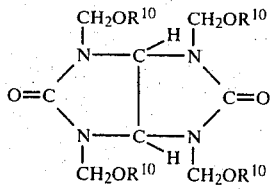

(II)

wherein the substituents $R^{10}$ may be identical or different and each is hydrogen, $C_1$-$C_6$-alkyl or low molecular weight alkoxyalkyl.

5. The process as claimed in claim 1 or 2, wherein said N-methylol compound or N-methylol-ether compound is a compound of the formula:

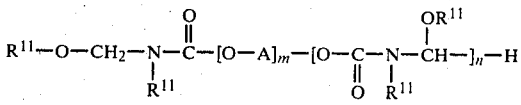

(III)

wherein the substituents $R^{11}$ may be identical or different and each is hydrogen, $C_1$-$C_6$-alkyl or low molecular weight alkoxyethyl, A is an aliphatic hydrocarbon radical of 2 to 8 atoms, n is 0 or 1 and m is from 1 to 9.

6. The process as claimed in claim 1, wherein said copolymer contains at least a 40 percent by weight of said ethylenically unsaturated carboxylic acid.

7. A print paste for printing textile materials, consisting essentially of:

a synthetic thickening agent, a disperse dye and from 40 to 250 parts by weight of a compound selected from the group consisting of N-methylol compounds of urea and urea derivatives, N-methylol ether compounds of urea and urea derivatives, and N-methylol and N-methylol ether compounds of carbamic acid esters per 1000 parts by weight of said print paste.

8. A process for printing textile materials consisting of cellulose fibers or mixtures thereof with synthetic fibers, comprising:

formulating a print paste consisting essentially of a synthetic thickening agent which is a homopolymer or copolymer of 3 to 5 carbon atoms, a disperse dye, a fixing agent and optionally at least one assistant selected from the group consisting of emulsifiers, dispersants, levelling agents, pH regulators, fixing accelerators, anti-foam agents, oxidizing agents and reducing agents, said formulation containing from 40 to 250 parts by weight of a fixing agent selected from the group consisting of N-methylol compounds of urea and urea derivatives, N-methylol ether compounds of urea and urea derivatives, and N-methylol and N-methylol ether compounds of carbamic acid esters per 1000 parts by weight of said print paste; and applying said print paste to said textiles; and fixing said dye at an elevated temperature.

* * * * *